US007755551B2

(12) United States Patent
Lindackers et al.

(10) Patent No.: US 7,755,551 B2
(45) **Date of Patent: *Jul. 13, 2010**

(54) MODULAR ANTENNA ASSEMBLY FOR AUTOMOTIVE VEHICLES

(75) Inventors: Ralf Lindackers, Royal Oak, MI (US); Hasan Yasin, Holly, MI (US); Andreas D. Fuchs, Lake Orion, MI (US); Ayman Duzdar, Holly, MI (US)

(73) Assignee: Laird Technologies, Inc., Chesterfield, MO (US)

( * ) Notice: Subject to any disclaimer, the term of this patent is extended or adjusted under 35 U.S.C. 154(b) by 319 days.

This patent is subject to a terminal disclaimer.

(21) Appl. No.: 11/962,471

(22) Filed: Dec. 21, 2007

(65) Prior Publication Data

US 2008/0111752 A1 May 15, 2008

Related U.S. Application Data

(63) Continuation-in-part of application No. 11/271,372, filed on Nov. 10, 2005, now Pat. No. 7,333,065.

(51) Int. Cl.
*H01Q 1/32* (2006.01)

(52) U.S. Cl. ..... 343/713; 343/872

(58) Field of Classification Search ..... 343/711, 343/712, 713, 872

See application file for complete search history.

(56) References Cited

U.S. PATENT DOCUMENTS

| | | | | |
|---|---|---|---|---|
| 6,023,245 | A | 2/2000 | Gomez et al. | |
| D461,796 | S | 8/2002 | Boyer | |
| D465,480 | S | 11/2002 | Boyer | |
| 6,674,412 | B1 | 1/2004 | Schmidt et al. | |
| 6,762,727 | B2 | 7/2004 | Rochford et al. | |
| 6,788,264 | B2 * | 9/2004 | Du | 343/725 |
| 6,879,294 | B2 | 4/2005 | Yuanzhu | |
| 6,930,643 | B2 | 8/2005 | Byrne et al. | |
| 7,283,100 | B2 * | 10/2007 | Thompson et al. | 343/713 |
| 7,333,065 | B2 * | 2/2008 | Lindackers et al. | 343/713 |
| 7,429,958 | B2 * | 9/2008 | Lindackers et al. | 343/713 |
| 7,586,459 | B2 * | 9/2009 | Noro et al. | 343/872 |
| 2005/0093755 | A1 | 5/2005 | Byrne et al. | |
| 2007/0085361 | A1 | 4/2007 | Hauser | |
| 2007/0171138 | A1 | 7/2007 | Noro | |

* cited by examiner

*Primary Examiner*—Tho G Phan
(74) *Attorney, Agent, or Firm*—Harness, Dickey & Pierce, P.L.C.

(57) ABSTRACT

The specification discloses various embodiments of modular antenna assemblies for automotive vehicles. In one exemplary embodiment, an antenna generally includes a base assembly that may be used on a variety of vehicle platforms. The antenna may also include a radome assembly that is specific to a particular vehicle platform. The radome assembly may snap-fit onto the base assembly, and be installed during or after vehicle assembly. A wide variety of radome assemblies of different shapes, styles, and colors may be used in conjunction with a single base assembly.

35 Claims, 15 Drawing Sheets

MODULAR ANTENNA ASSEMBLY FOR AUTOMOTIVE VEHICLES

CROSS-REFERENCE TO RELATED APPLICATION

This application is a continuation-in-part of allowed U.S. application Ser. No. 11/271,372 filed Nov. 10, 2005, now U.S. Pat. No. 7,333,065 the entire disclosure of which is incorporated herein by reference in its entirety.

FIELD

The present disclosure relates to antennas, and more specifically to antennas for automotive vehicles.

BACKGROUND

The statements in this section merely provide background information related to the present disclosure and may not constitute prior art.

A wide variety of antennas have been developed for automotive vehicles. The antennas are adapted to receive signals in a variety of formats, including but not limited to AM radio, FM radio, satellite radio, global positioning system (GPS), cell phones, and citizens band (CB). Often, the antennas are designed for a specific location on the vehicle. For example, antennas for receiving circularly polarized signals, such as those associated with satellite radio and GPS, are typically mounted on the vehicle roof.

An antenna designed for installation on a vehicle body panel, such as the vehicle roof, must address a variety of issues in addition to receiving signals. First, the antenna should be aesthetically pleasing—at least to the extent possible in view of its functionality. Second, the antenna should conform closely to the body panel on which it is mounted. To achieve these goals, the antenna is shaped to match the contour of the body panel on which it will be mounted. Consequently, each antenna must be uniquely designed for the vehicle platform. An antenna designed for one platform typically will not be acceptable for mounting on a different platform having a different shape. The need to have unique antennas for unique vehicles undesirably increases design complexity, manufacturing complexity, and inventory complexity.

SUMMARY

In an exemplary embodiment, an automotive vehicle antenna generally includes a base assembly mountable on a vehicle and a radome assembly attachable to the base assembly. The radome assembly includes a lower peripheral edge adapted to closely conform to the vehicle when the antenna is mounted on the vehicle.

Another exemplary embodiment includes an automotive vehicle having a vehicle portion and an antenna assembly. The antenna assembly includes a base assembly mounted on the vehicle portion, and a radome assembly mounted on the base assembly. The radome assembly includes a skirt terminating in a peripheral lower edge closely conforming to the vehicle portion.

Other aspects of the present disclosure provide methods relating to installation of antenna assemblies. In one exemplary method embodiment, a method generally includes attaching a base assembly to a vehicle, shipping a radome assembly with the vehicle having the base assembly attached thereto, and subsequent to shipping, attaching the radome assembly to the base assembly.

In another exemplary embodiment, a method generally includes attaching a radome assembly to a base assembly such that a lower peripheral edge of the radome assembly is in close conformance with a vehicle body wall to which the base assembly is attached, to thereby achieve a zero gap appearance.

In another exemplary embodiment, a method is provided relating to installation of antenna assemblies to vehicles having different vehicle platforms. The method may generally include attaching a first base assembly to a first vehicle and attaching a first radome assembly to the first base assembly. The first radome assembly may be configured such that a lower peripheral edge thereof fits closely against the first vehicle to thereby achieve a zero gap appearance therewith. The method may also include attaching a second base assembly to a second vehicle associated with a different platform than the first vehicle. The first and second base assemblies may have a common configuration. The method may further include attaching a second radome assembly to the second base assembly. The second radome assembly may be configured such that a lower peripheral edge thereof fits closely against the second vehicle to thereby achieve a zero gap appearance therewith.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
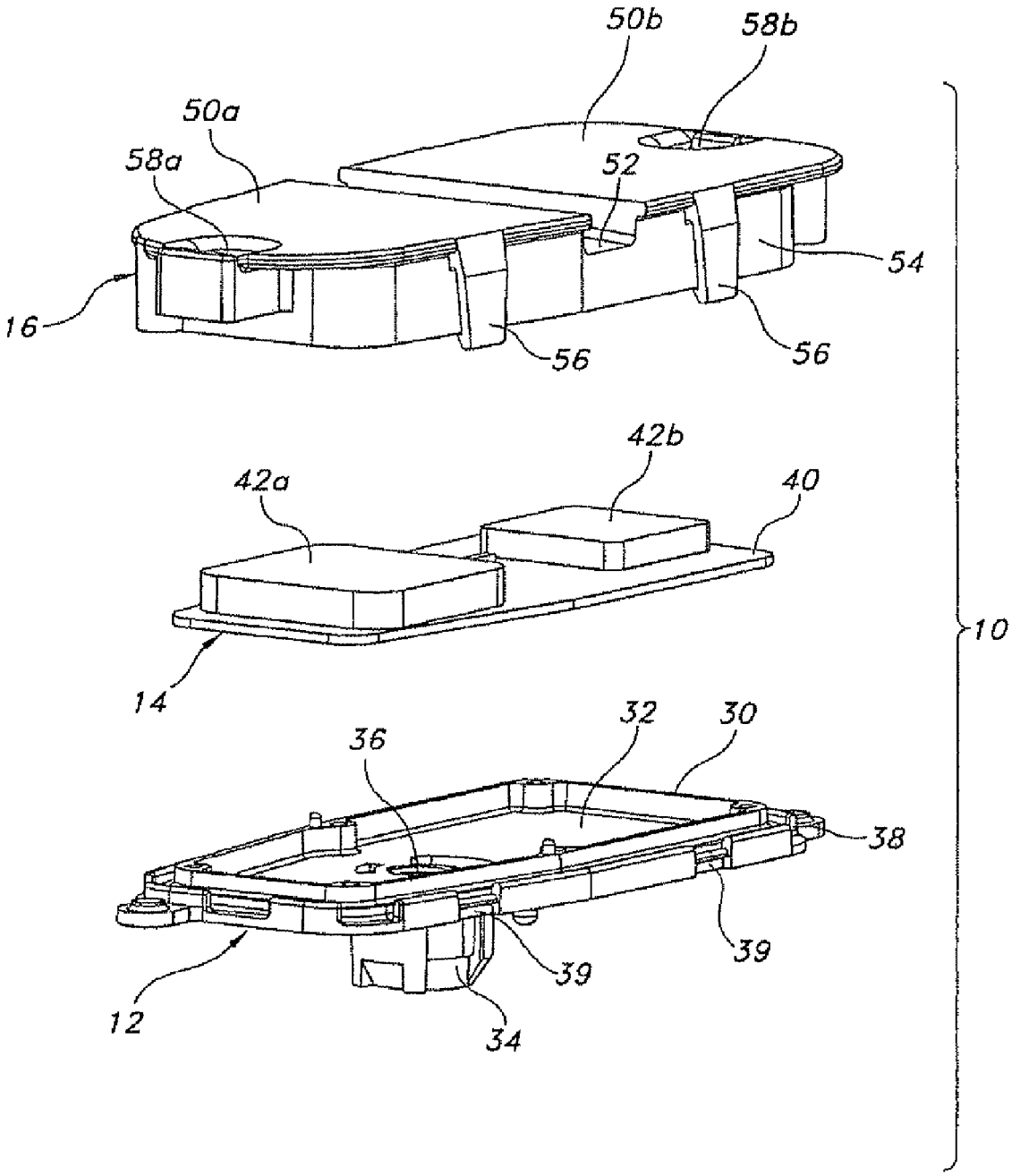
FIG. 1 is a perspective exploded view of a base assembly of an antenna assembly according to an exemplary embodiment.

The following description is merely exemplary in nature and is not intended to limit the present disclosure, application, or uses. It should be understood that throughout the drawings, corresponding reference numerals indicate like or corresponding parts and features.

The specification discloses various embodiments of modular antenna assemblies for automotive vehicles. In one exemplary embodiment, an antenna generally includes a base assembly that may be used on a variety of vehicle platforms. The antenna may also include a radome assembly that is specific to a particular vehicle platform. The radome assembly may snap-fit onto the base assembly, and be installed during or after vehicle assembly. A wide variety of radome assemblies of different shapes, styles, and colors may be used in conjunction with a single base assembly.

In an exemplary embodiment, an automotive vehicle antenna generally includes a base assembly mountable on a vehicle and a radome assembly attachable to the base assembly. The radome assembly includes a lower peripheral edge adapted to closely conform to the vehicle when the antenna is mounted on the vehicle.

Another exemplary embodiment includes an automotive vehicle having a vehicle portion and an antenna assembly. The antenna assembly includes a base assembly mounted on the vehicle portion, and a radome assembly mounted on the base assembly. The radome assembly includes a skirt terminating in a peripheral lower edge closely conforming to the vehicle portion.

Other aspects of the present disclosure provide methods relating to installation of antenna assemblies. In one exemplary method embodiment, a method generally includes attaching a base assembly to a vehicle, shipping a radome assembly with the vehicle having the base assembly attached thereto, and subsequent to shipping, attaching the radome assembly to the base assembly.

In another exemplary embodiment, a method generally includes attaching a radome assembly to a base assembly such that a lower peripheral edge of the radome assembly is in close conformance with a vehicle body wall to which the base assembly is attached, to thereby achieve a zero gap appearance.

In another exemplary embodiment, a method is provided relating to installation of antenna assemblies to vehicles having different vehicle platforms. The method may generally include attaching a first base assembly to a first vehicle and attaching a first radome assembly to the first base assembly. The first radome assembly may be configured such that a lower peripheral edge thereof fits closely against the first vehicle to thereby achieve a zero gap appearance therewith. The method may also include attaching a second base assembly to a second vehicle associated with a different platform than the first vehicle. The first and second base assemblies may have a common configuration. The method may further include attaching a second radome assembly to the second base assembly. The second radome assembly may be configured such that a lower peripheral edge thereof fits closely against the second vehicle to thereby achieve a zero gap appearance therewith.

Accordingly, the aforementioned problems noted above in the Background may be overcome by one or more of the exemplary disclosed embodiments of modular antenna assemblies for automotive vehicles. As disclosed herein, various embodiments may enable a common antenna platform (the base assembly) to be utilized across a wide variety of vehicle platforms, while only the radome assembly is unique to a vehicle platform.

Exemplary embodiments of antenna assemblies are illustrated in the drawings. In such embodiments, the antenna assembly generally includes a base assembly (e.g., antenna assembly 10 shown in FIGS. 1 and 3, antenna assembly 110 shown in FIGS. 13, 14, and 15, etc.) and a radome assembly (e.g., radome assembly 20 shown FIGS. 2 and 4, radome assembly 120 shown in FIG. 14, etc.). When installed on a vehicle, the base assembly may be secured directed to the vehicle body panel, and the radome assembly may be snap-fitted onto the base assembly in some embodiments.

Figure 3:
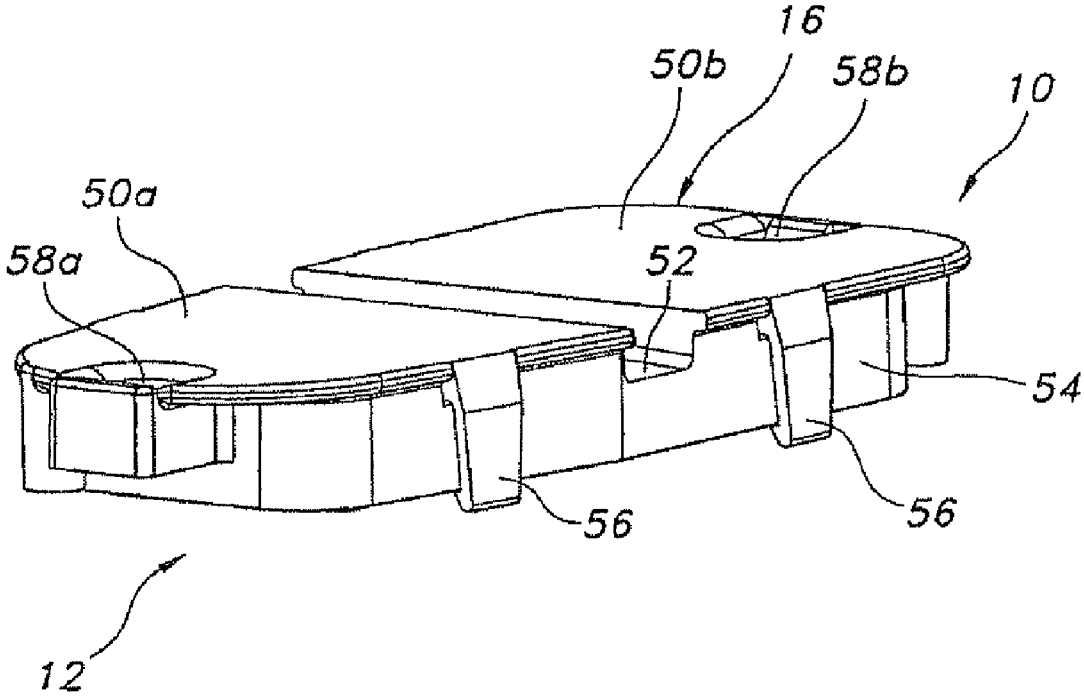
FIG. 3 is a perspective view of the assembled base assembly shown in FIG. 1.

An exemplary embodiment of a base assembly 10 is illustrated in FIG. 1 (exploded) and FIG. 3 (assembled). As shown, the base assembly 10 generally includes a chassis 12, a printed circuit (PC) board assembly 14, and a base cover 16.

The chassis 12 is die cast of zinc, although other manufacturing processes and materials may be used. The chassis 12 includes a generally planar body 30 defining a pocket 32 in its upper surface. An attachment stud or lug 34 extends from the underside of the body 30 for attachment to a vehicle body panel in a conventional fashion. The lug 34 defines a central aperture 36 extending through the body 30 and the lug 34 for receiving electrical wires and/or leads. A groove 38 extends around the upper surface of the body 30 for receiving the base cover 16. The chassis 12 also defines a plurality of recesses or receivers 39 for receiving the catches 56 on the base cover 16.

The PC board assembly 14 includes a printed circuit (PC) board 40 and a pair of ceramic antenna elements 42*a* and 42*b* mounted thereon. In the current embodiment, each antenna element 42*a*, 42*b* is ceramic-based. The antenna elements 42*a*, 42*b* are designed for the reception of satellite radio signals and GPS signals, respectively. Other suitable antenna elements may be used. The PC board 40 is dimensioned to be received within the pocket 32 on the chassis 12. Electrical wires and/or leads (not shown in this embodiment, but shown in FIG. 13 for alternative embodiment) extend from the printed circuit board 40 through the hole 36 in the chassis 12.

The base cover 16 is fabricated of plastic as a single piece. Other suitable materials and manufacturing processes may also be used. The base cover 16 includes a generally planar body 50 having two portions 50*a* and 50*b* defining a groove 52 therebetween for receiving the radome assembly antenna element 70. A perimeter skirt or flange 54 extends downwardly from the body 50 and is received within the groove 38. A plurality of spring-loaded catches 56 extend downwardly from the body 50 to snap-fit onto the chassis 12 and specifically within the receivers 39. The body 50 defines a pair of receivers or sockets 58*a* and 58*b*. The sockets 58*a*, 58*b* receive snap fingers 64*a*, 64*b* on the radome assembly 20 as will be described.

FIG. 3 illustrates the base assembly 10 assembled. The PC board 14 (not visible in FIG. 3) is nested within the pocket 32 (also not visible in FIG. 3) of the chassis 12. The skirt 54 of the base cover 16 fits within the groove 38. A conventional seal such as rubber gasket or a sealant (e.g., seal 196 shown in FIG. 13, etc.) may be included within the groove 38 to improve the seal between the base cover 16 and the chassis 12. The catches 56 snap-fit around the chassis 12. When so assembled, the various parts are securely interconnected and retained together, and the PC board 14 is sealed within the base assembly 10.

Figure 2:
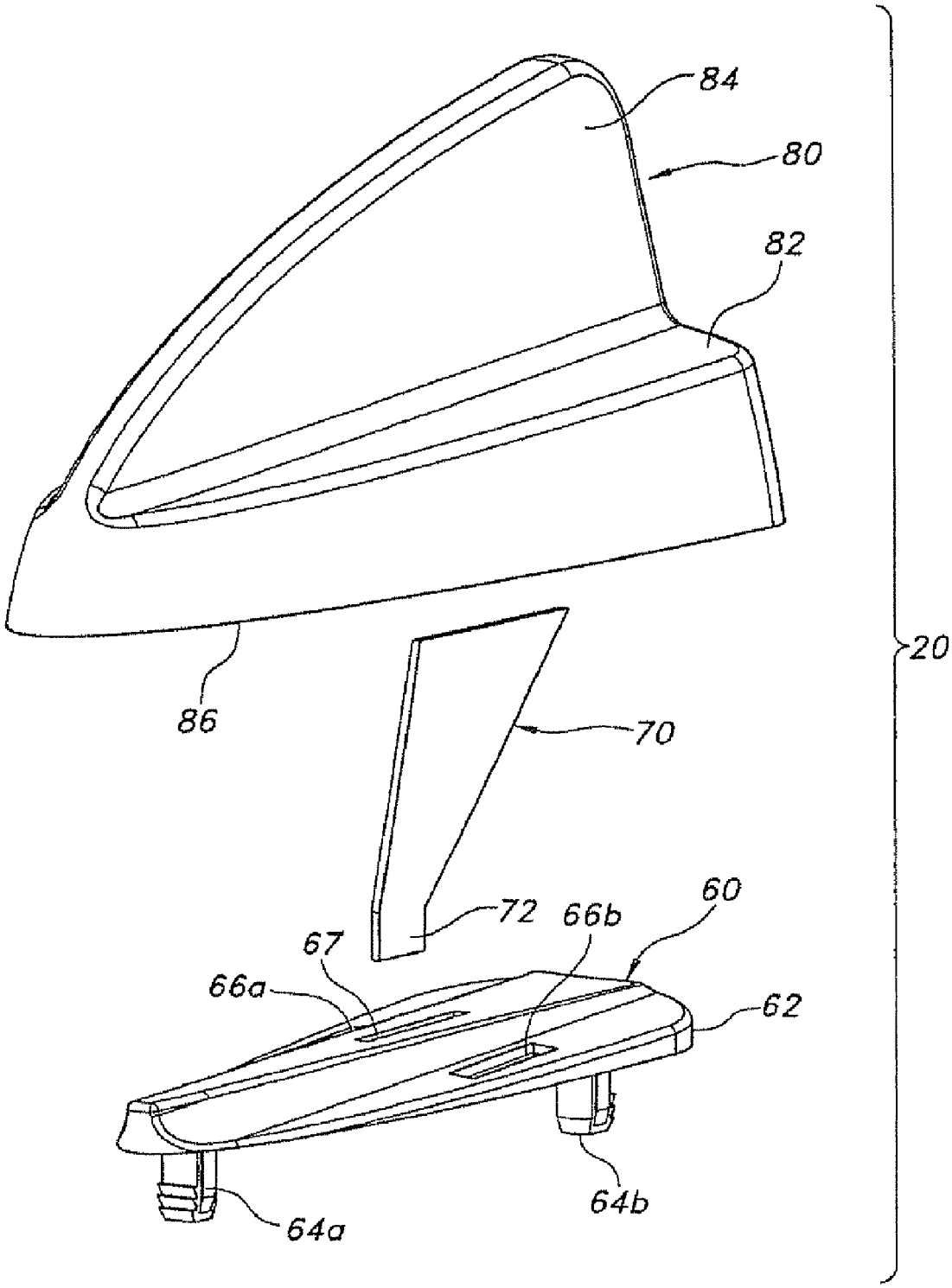
FIG. 2 is a perspective exploded view of a radome assembly of an antenna assembly according to an exemplary embodiment.
Figure 4:
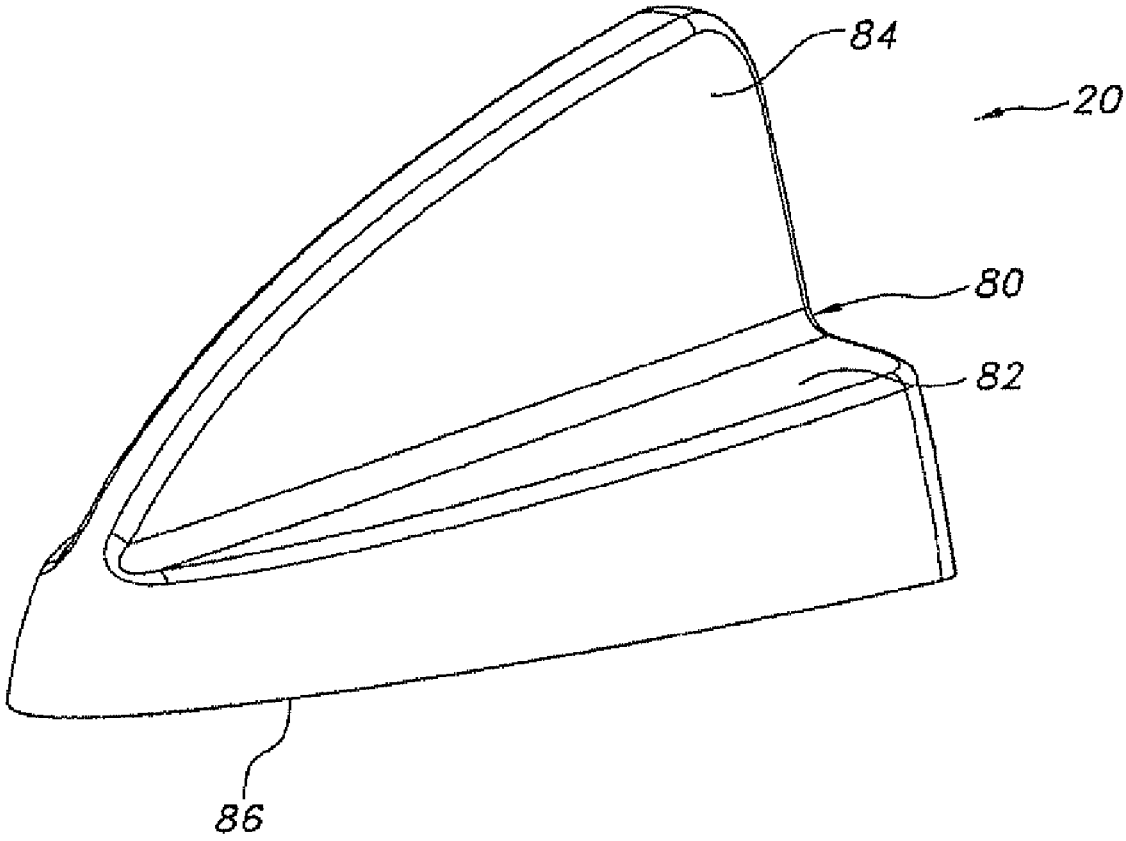
FIG. 4 is a perspective view of the assembled radome assembly shown in FIG. 2.
Figure 5:
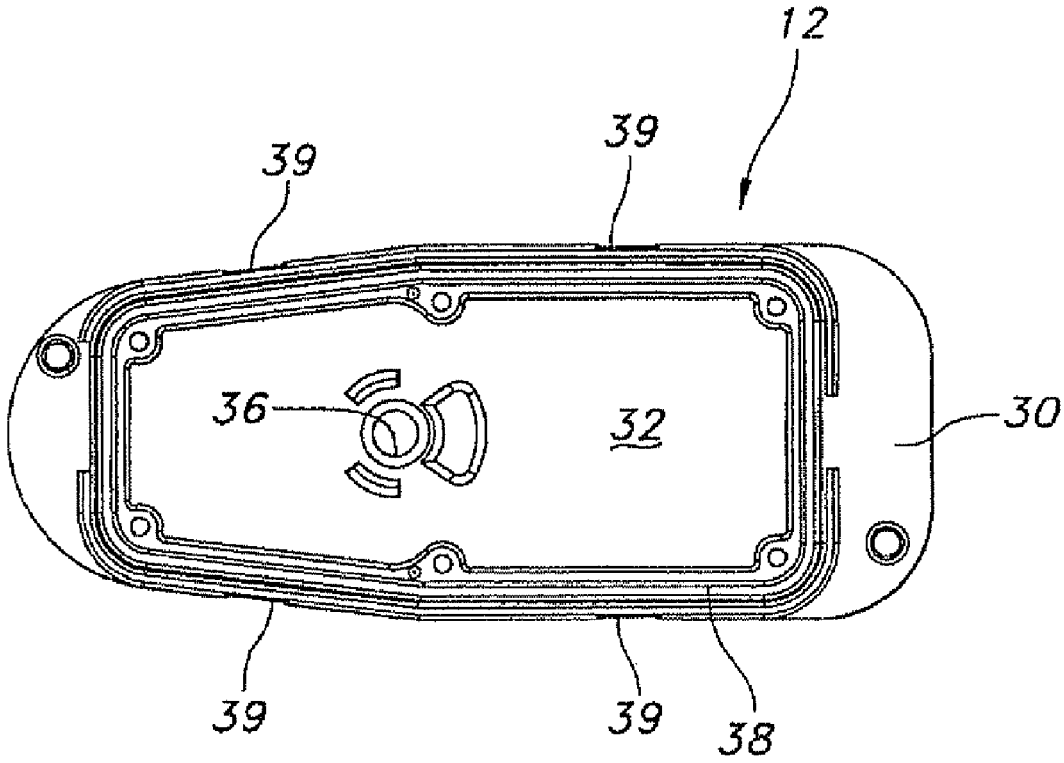
FIG. 5 is a top plan view of the chassis of the base assembly shown in FIG. 1.
Figure 6:
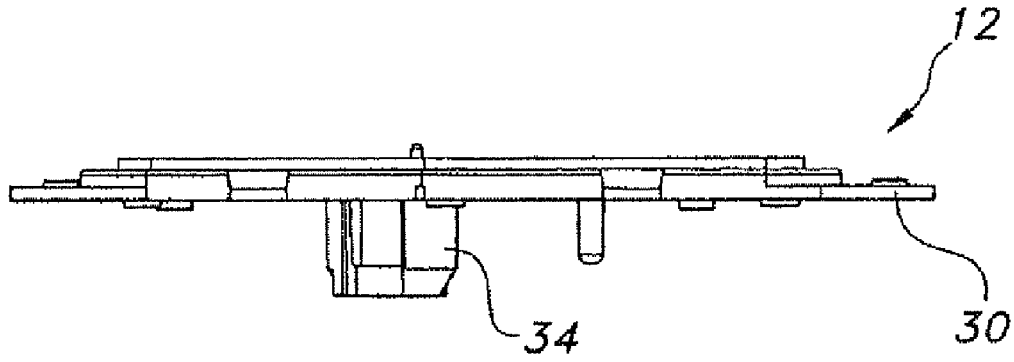
FIG. 6 is a side elevational view of the chassis shown in FIG. 5.
Figure 7:
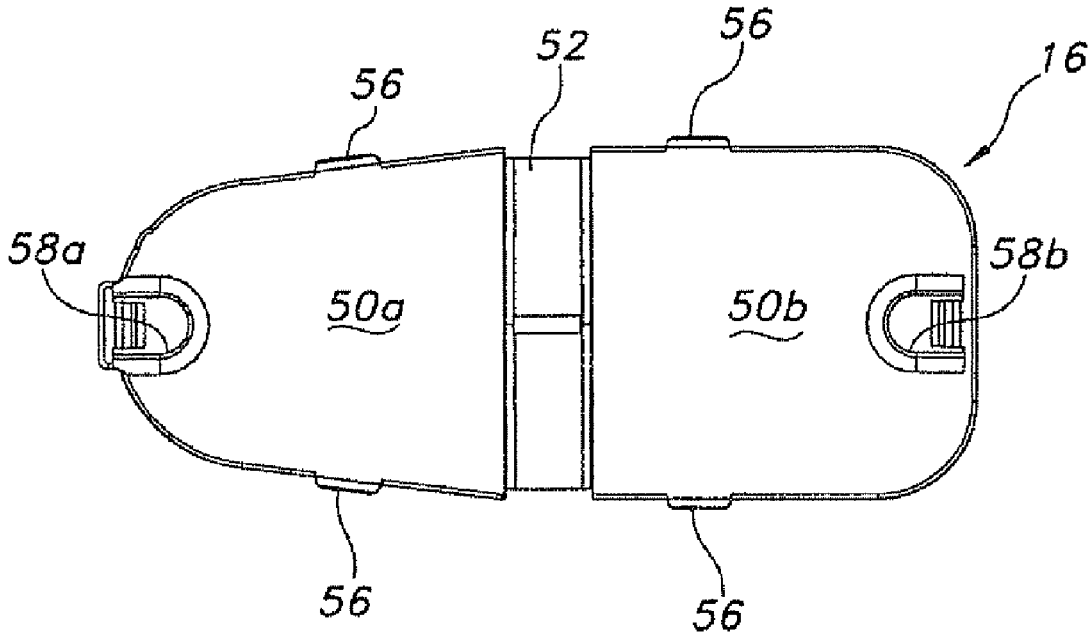
FIG. 7 is a top plan view of the base cover of the base assembly shown in FIG. 1.
Figure 8:
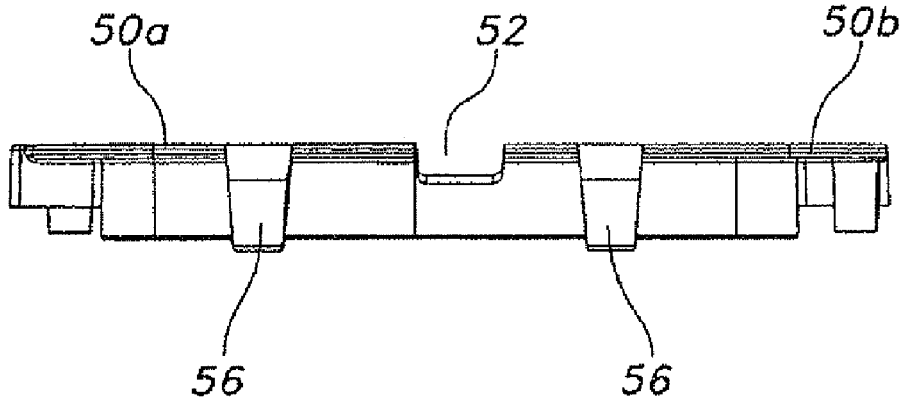
FIG. 8 is a side elevational view of the base cover shown in FIG. 7.
Figure 9:
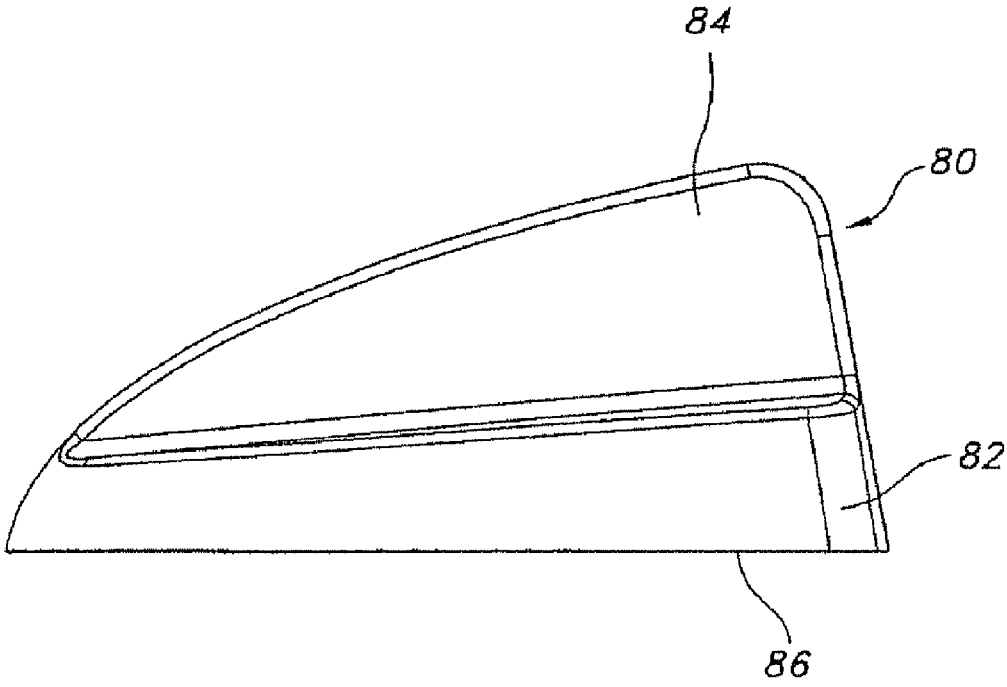
FIG. 9 is a side elevational view of the radome of the radome assembly shown in FIG. 2.

An exemplary embodiment of a radome assembly 20 is illustrated in FIG. 2 (exploded) and FIG. 4 (assembled). As shown, the radome assembly 20 generally includes a radome 80, a connector piece 60, and an antenna element 70.

The radome 80 is configured to house one or more antenna elements 70. The radome 80 may also be configured to be aesthetically pleasing and/or aerodynamic. The radome 80 includes a body portion 82 and a center fin 84 extending upwardly therefrom. A pair of locator elements 59*a* and 59*b* (FIG. 10) extend downwardly from the interior of the center fin 84. The body portion 82 terminates in a lower peripheral edge 86, which extends around the entire perimeter of the radome 80. The lower peripheral edge 86 is configured to closely conform to the particular automotive vehicle body panel on which the antenna assembly will be mounted. The close contour design achieves a "zero gap" appearance between the antenna and the vehicle.

The antenna element 70 may be secured within the radome 80 using techniques known to those skilled in the art. The lower portion 72 of the antenna element 70 extends into the groove 52 in the base assembly 10 for effective coupling to the PC board assembly 14. The coupling in the current embodiment is inductive or galvanic, and other coupling techniques (such as electrically-conductive silicone) may be used. The antenna element 70 in the current embodiment is designed for cellular phone signals, but the antenna element 70 could be designed for other signals. It is envisioned that more than one element could be included in the radome. It also is envisioned that other embodiments may be configured without any antenna element in the radome, in which case the center fin 84 might be omitted.

Figure 10:
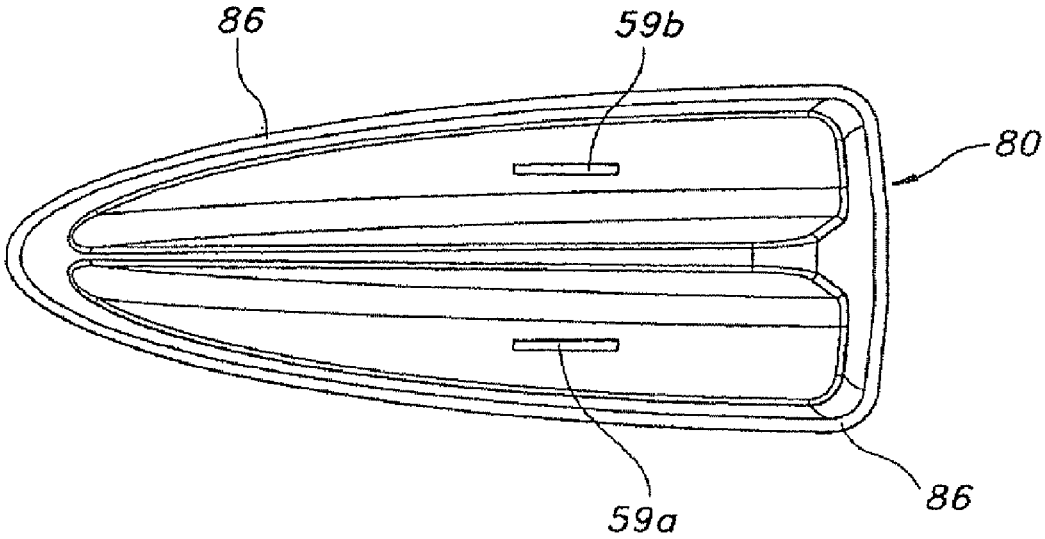
FIG. 10 is a bottom plan view of the radome shown in FIG. 9.
Figure 11:
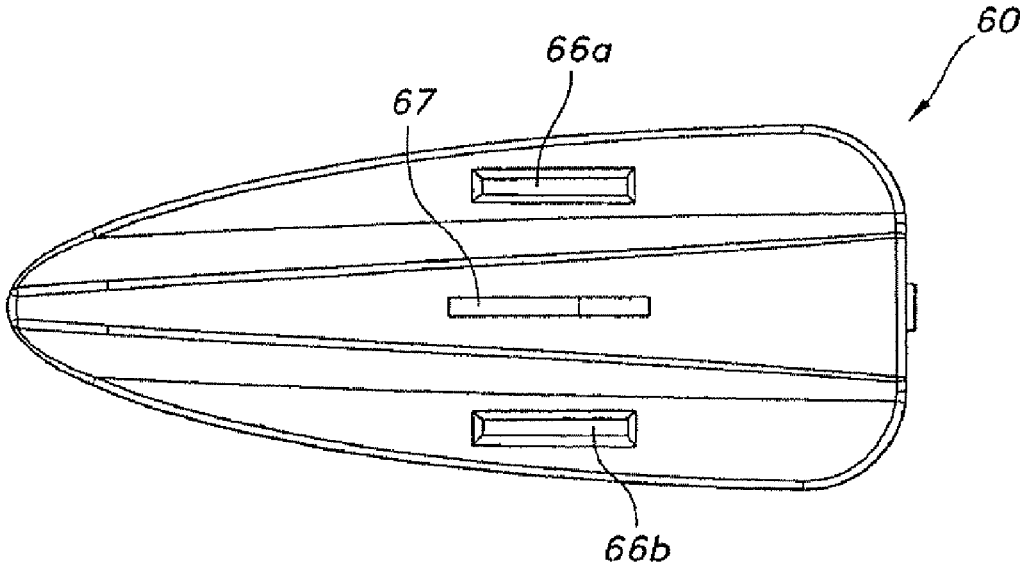
FIG. 11 is a top plan view of the connector piece of the radome assembly shown in FIG. 2.
Figure 12:
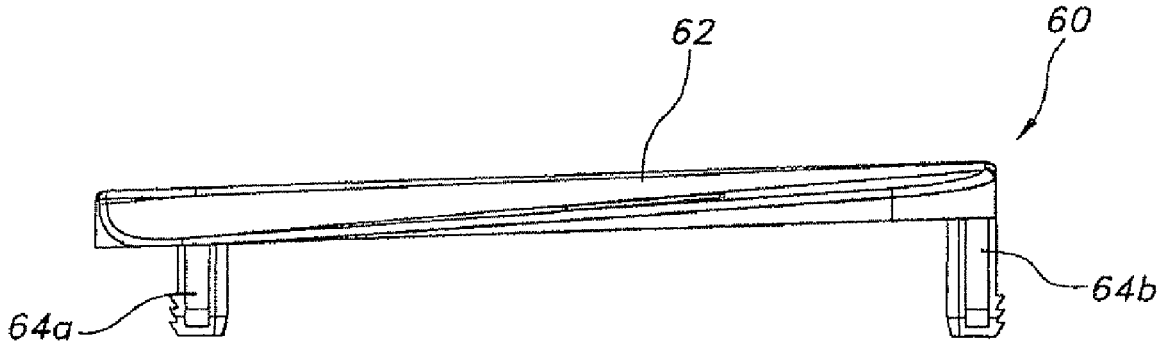
FIG. 12 is a side elevational view of the connector piece shown in FIG. 11.

With continued reference to FIG. 2, the connector piece 60 provides a means of connecting the radome assembly 20 to the base assembly 10. As shown in FIG. 2, the connector piece 60 includes a body 62 defining a pair of slots 66*a* and 66*b* for receiving the connector elements 59*a* and 59*b* respectively on the radome 80 (FIG. 10). The body 62 of the connector piece 60 also defines a slot 67 through which the lower portion 72 of the antenna element 70 extends. A pair of barbed connectors 64*a* and 64*b* extend downwardly from the connector piece body 62 to be received in the receivers 58*a* and 58*b* of the base cover 16 (FIG. 1).

In the assembled state of the radome assembly 20 as shown in FIG. 4, the connector piece 60 is closely received within the body portion 82 of the radome 80 with the antenna element 70 secured therebetween. The locator elements 59*a* and 59*b* from the radome 80 extend through the slots 66 to assist in locating the radome 80 and the connector piece 60. The two parts are solvent welded together. Alternatively, adhesive or other suitable means may be used to intersecure the two components.

An exemplary installation process will now be described for the base assembly 10 and radome assembly 20. In various embodiments, the base assembly 10 is not specific to a vehicle platform. Instead, the base assembly 10 may be used across a wide variety of vehicle platforms having a wide variety of body panel configurations. The base assembly 10 may be delivered to the vehicle manufacturer for installation on a vehicle during vehicle assembly in conventional fashion—typically to the vehicle roof.

The radome assembly 20 may also be delivered to the vehicle manufacturer. But the radome assembly 20 typically is not installed on the vehicle during vehicle assembly. Because of the height restrictions related to vehicle shipping, the radome assembly 20 may be shipped uninstalled with the vehicle, for example, in the glove box of the vehicle. After the vehicle is received by the dealer, the radome assembly 20 may be removed from the glove box and installed on the base assembly 10 simply by aligning the fingers 64 (FIG. 2) of the radome assembly 20 with the receivers 58 of the base assembly 10 (FIG. 3), and then pushing the radome assembly 20 generally downwardly onto the base assembly 10. After being installed, the lower edge 86 of the radome 80 lies against and conforms to the vehicle body panel. The radome 80 can be color matched to the vehicle.

Figure 13:
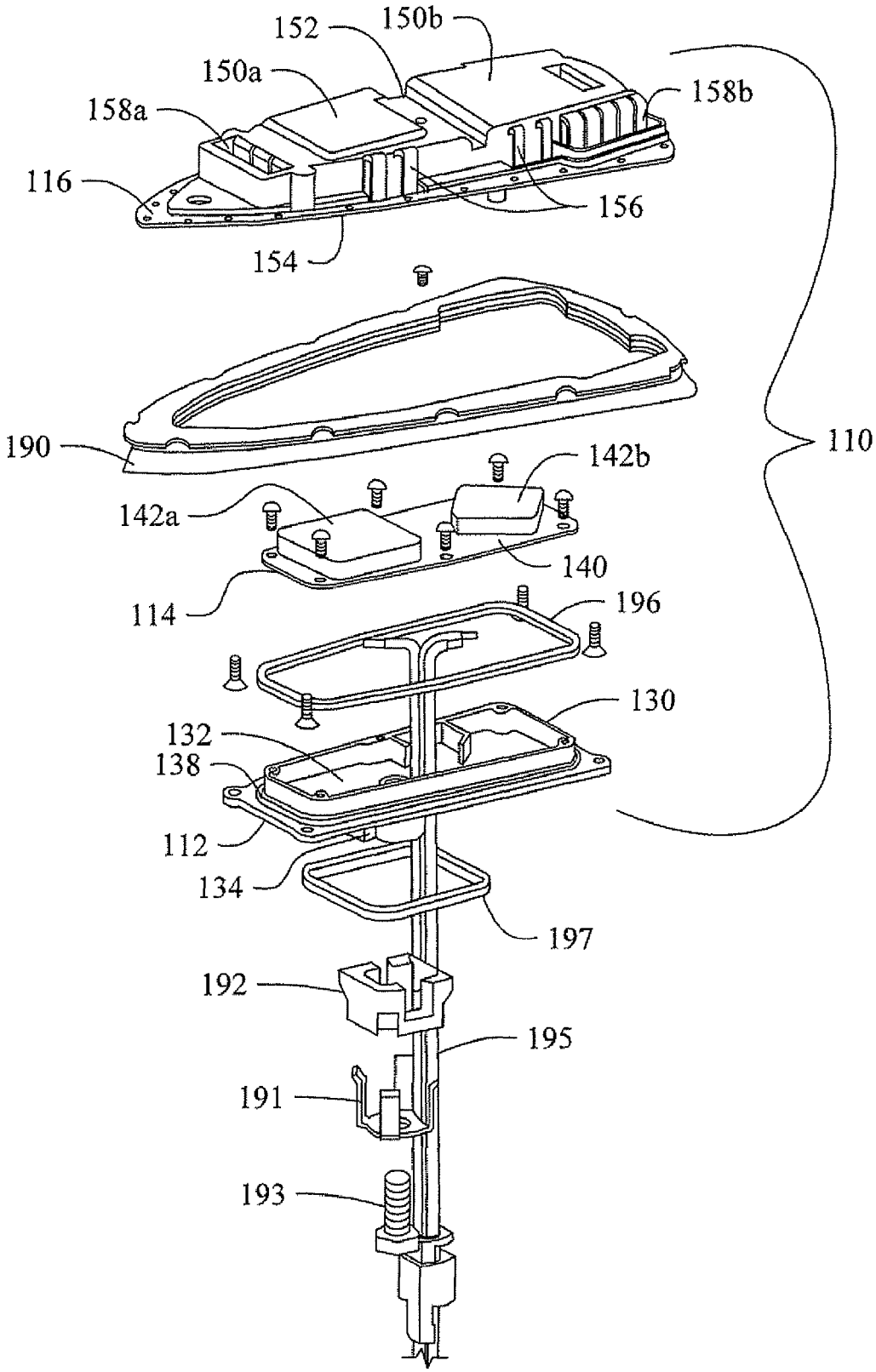
FIG. 13 is a perspective exploded view illustrating a base assembly of an antenna assembly according to an exemplary embodiment.
Figure 15:
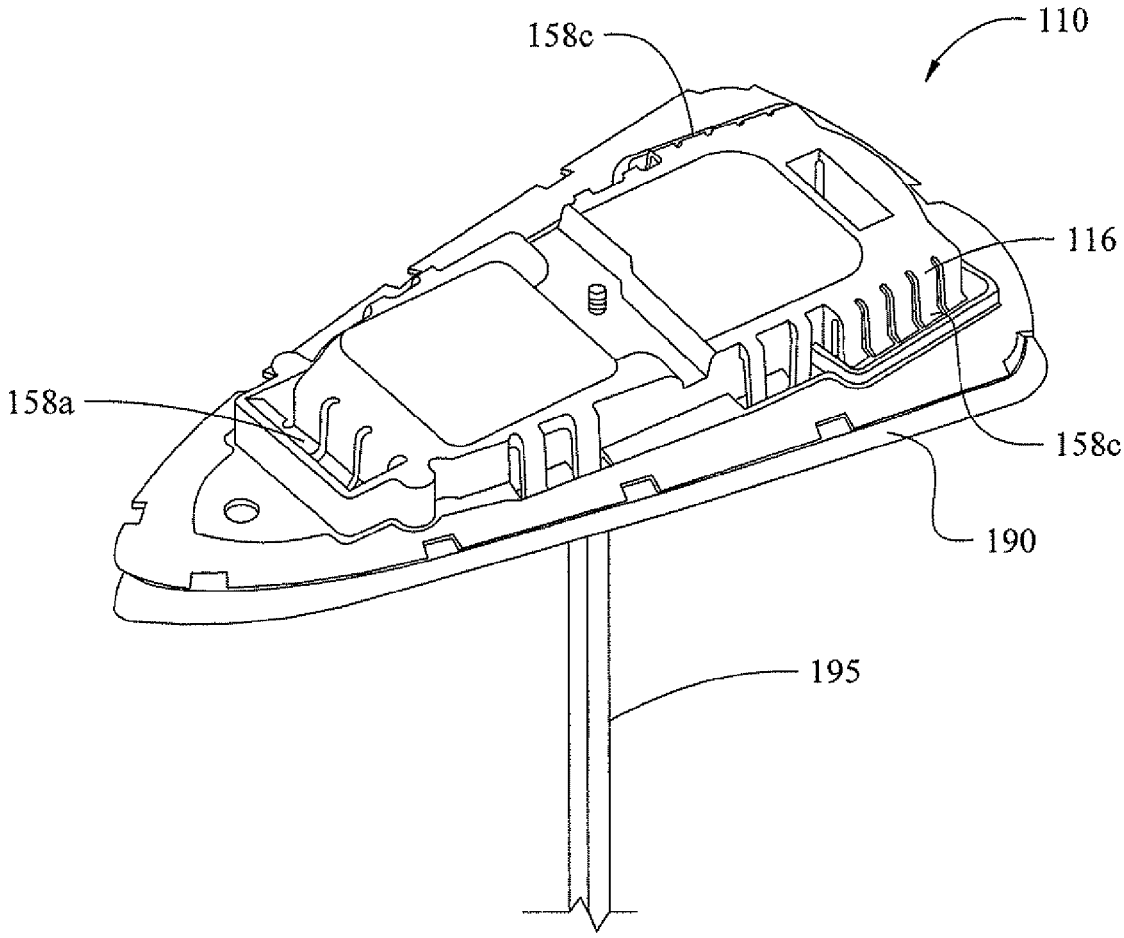
FIG. 15 is an upper perspective view of the assembled base assembly shown in FIG. 13.
Figure 16:
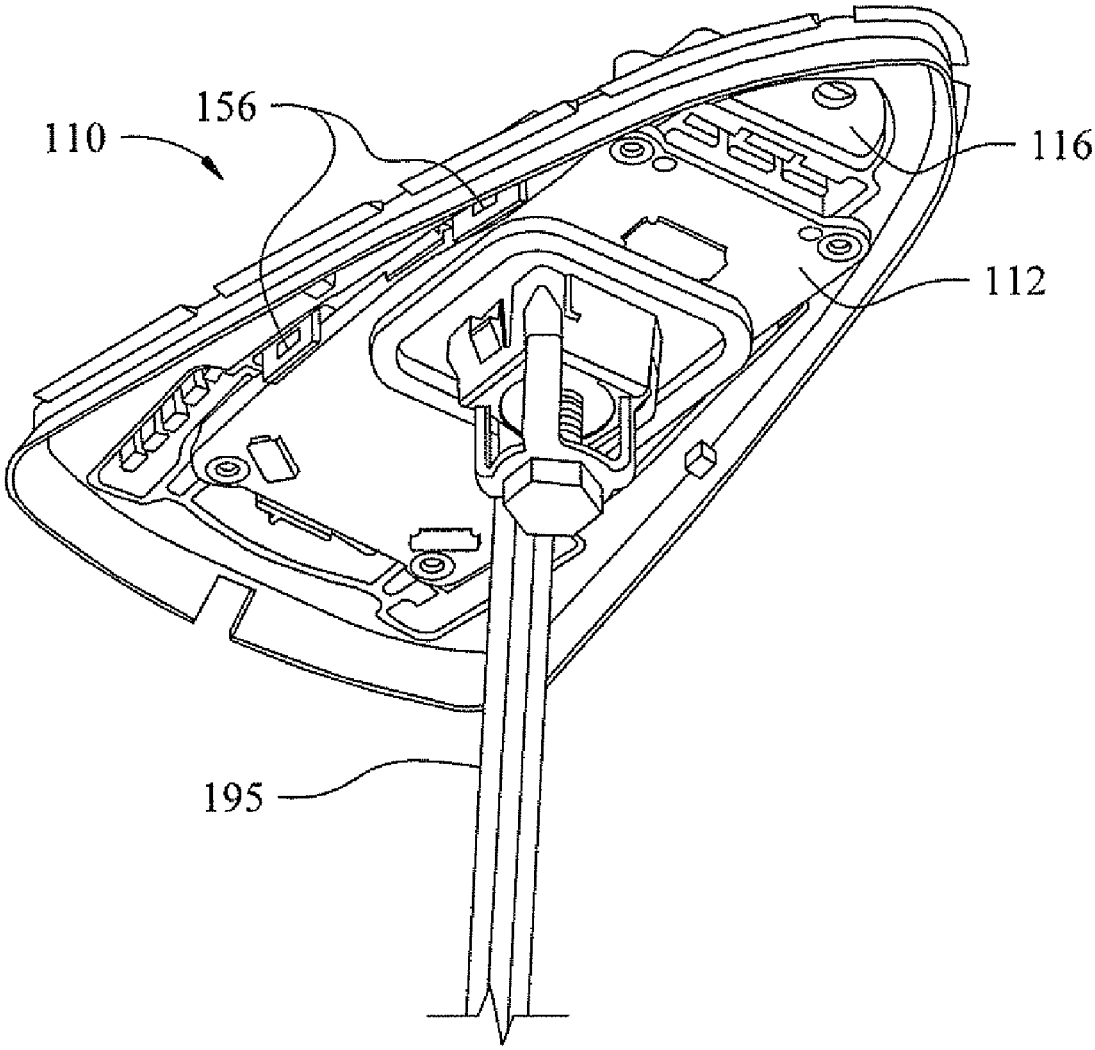
FIG. 16 is an lower perspective view of the assembled base assembly shown in FIG. 15.
Figure 17:
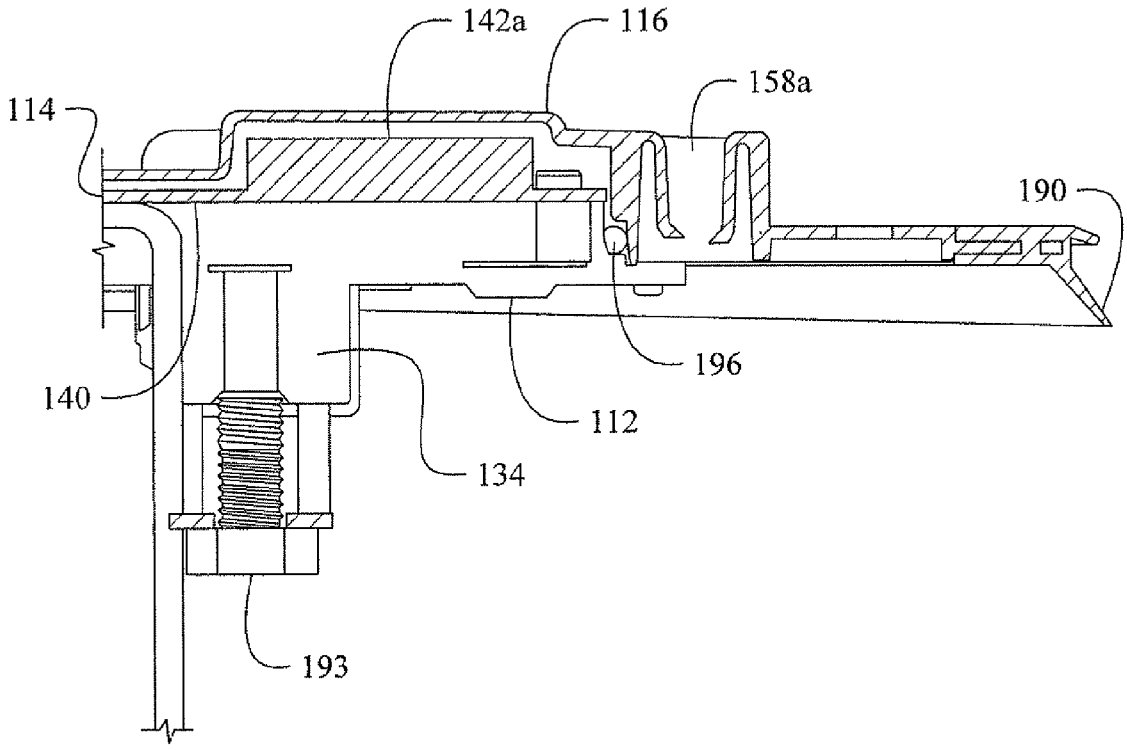
FIG. 17 is a partial side elevational view of a portion of the assembled base assembly shown in FIGS. 15 and 16.

Another exemplary embodiment of a base assembly 110 is illustrated in FIG. 13 (exploded) and FIGS. 15 and 16 (assembled). As shown, the base assembly 110 generally includes a chassis 112, a printed circuit (PC) board assembly 114, and a base cover 116.

The chassis 112 includes a generally planar body 130 defining a pocket 132. An attachment stud or lug 134 extends from the underside of the body 130 for attachment to a vehicle body panel.

FIG. 13 also illustrates exemplary hardware that may be used for attaching the base assembly 110 to a vehicle. In this exemplary embodiment, first and second retaining components 191 and 192 and fastener member 193 may be used to interconnect with the attachment stud 134 to facilitate securing the base assembly 110 to a vehicle body wall. Also shown in FIG. 13 is a seal 197 (e.g., O-ring, resiliently compressible elastomeric or foam gasket, etc.) that may be used for substantially sealing the underside of the base assembly 110 and the external side of the vehicle body wall (e.g., vehicle roof, etc.). The seal 197 may help prevent (or at least inhibit) the ingress or penetration of water, moisture, dust, or other contaminants through the mounting opening into the interior of the vehicle after the antenna assembly is finally installed to the vehicle. The fastener member 193 (which is illustrated as an exemplary threaded bolt having a hexagonal head) may be used to secure the first and second retaining components 191 and 192 to the mounting structure 134 of the base assembly 110, in an exemplary manner disclosed in U.S. patent application Ser. No. 11/602,172 filed Nov. 20, 2006 and/or U.S. patent application Ser. No. 11/605,146 filed Nov. 28, 2006. The entire disclosures of these applications are incorporated herein by reference in their entireties. Alternative means may also be employed for securing the base assembly 110 to a vehicle body panel.

As shown in FIG. 13, the lug 134 defines an aperture extending through the body 130 and the lug 134 for receiving electrical wires and/or leads 195. A groove 138 extends around the upper surface of the body 130 for receiving the base cover 116. The chassis 112 may also include portions (recesses, receivers, perimeter lip, etc.) for engagement with catches 156 on the base cover 116.

The PC board assembly 114 includes a printed circuit (PC) board 140 and a pair of ceramic antenna elements 142*a* and 142*b* mounted thereon. In the current embodiment, each antenna element 142*a*, 142*b* is ceramic-based. The antenna elements 142*a*, 142*b* are designed for the reception of satellite radio signals and GPS signals, respectively. Other suitable antenna elements may be used in other embodiments. The PC board 140 is configured (e.g., shaped, dimensioned, etc.) to be received within the pocket 132 on the chassis 112. Electrical wires and/or leads 195 extend from the printed circuit board 140 through the hole 136 in the chassis 112.

Figure 18:
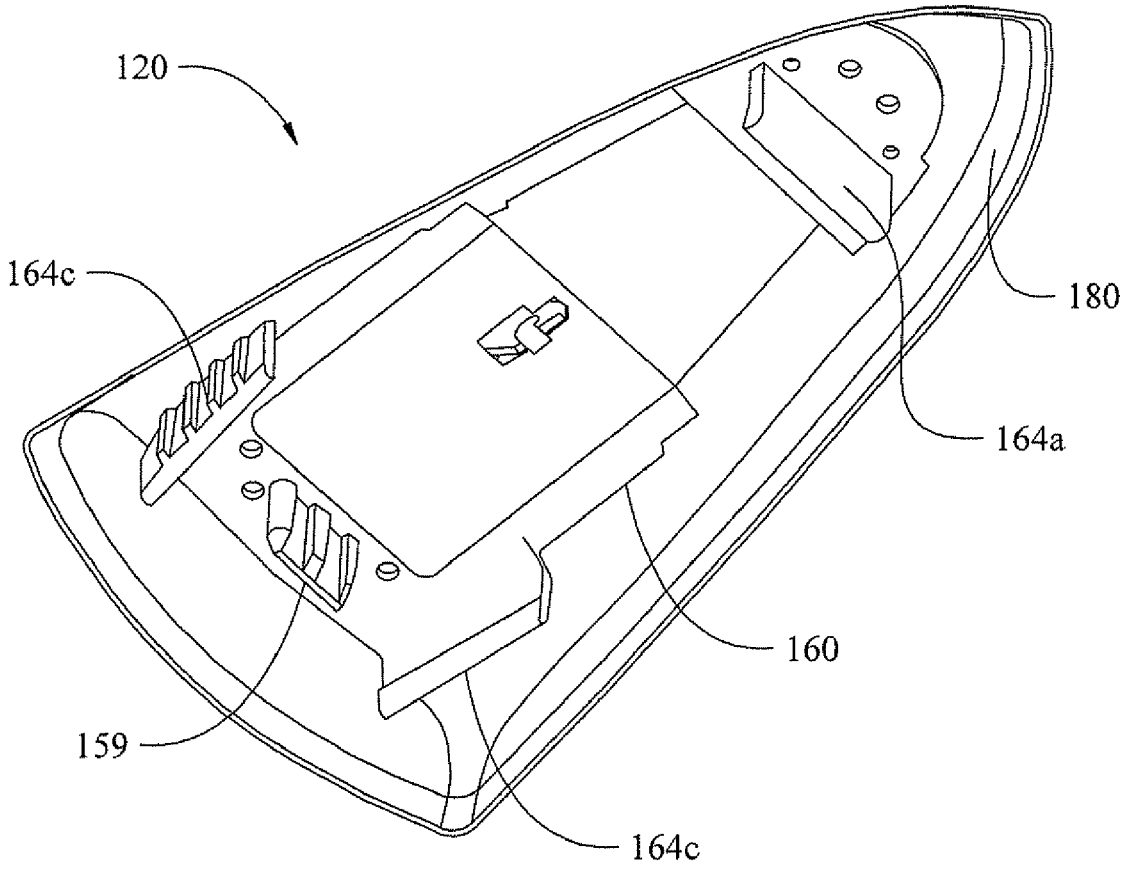
FIG. 18 is a lower perspective view of the assembled radome assembly shown in FIG. 14.

The base cover 116 includes a generally planar body 150 having two portions 150*a* and 150*b* defining a groove 152 therebetween for receiving the radome assembly antenna element 170. A perimeter skirt or flange 154 extends downwardly from the body 150 and is received within the groove 138. A plurality of spring-loaded catches 156 extend downwardly from the body 150 to snap-fit onto the chassis 112, such as engagement with recesses, receivers, lip portions, etc. The body 150 defines receivers or sockets 158*a*, 158*b*, 158*c*. The sockets 158*a*, 158*b*, 158*c* receive snap fingers 164*a*, 164*b*, 164*c* on the radome assembly 120. As shown by FIGS. 15 and 18, this particular embodiment thus includes one latching mechanism (158*a*, 164*a*) towards the front or forward portion, and two latching mechanisms (158*b*, 158*c*, 164*b*, 164*c*) towards the back or rearward portion.

As shown in FIGS. 13 and 15, the base assembly 110 of this embodiment also includes a seal 190 (e.g., rubber seal, etc.). The seal 190 may be configured to be positioned generally around a lower portion of the base cover 116, to thereby provide additional stability and/or to seal possible gaps with the vehicle body panel (e.g., vehicle roof, etc.).

FIG. 15 illustrates the base assembly 110 in its assembled condition in which the PC board 114 would be nested within the pocket 132 of the chassis 12. The skirt 154 of the base cover 116 fits within the groove 138. A conventional seal 196 (e.g., rubber gasket, etc.) may be included within the groove 138 to improve the seal between the base cover 116 and the chassis 112. The catches 156 snap-fit around the chassis 112. When so assembled, the various parts are securely interconnected and retained together, and the PC board 114 is sealed within the base assembly 110.

Figure 14:
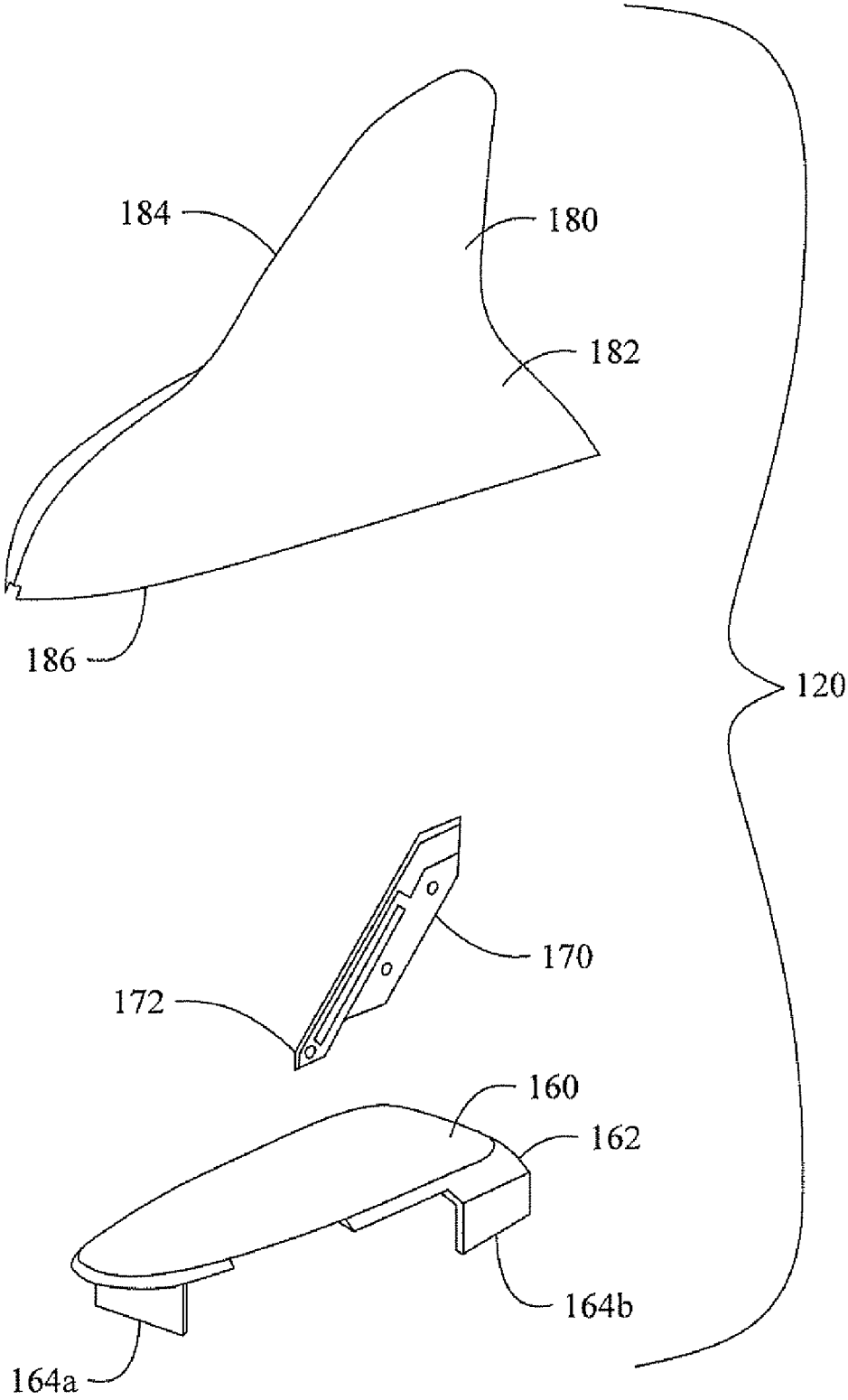
FIG. 14 is a perspective exploded view illustrating a radome assembly of an antenna assembly according to an exemplary embodiment.

Another exemplary embodiment of a radome assembly 120 is illustrated in FIG. 14 (exploded) and FIG. 18 (assembled). As shown in FIG. 14, the radome assembly 120 generally includes a radome 180, a connector piece 160, and an antenna element 170.

The radome 180 is configured to house one or more antenna elements 170. The radome 180 may also be configured to be aesthetically pleasing and/or aerodynamic. The radome 180 includes a body portion 182 and a center fin 184 extending upwardly therefrom. A locator element 159 (FIG. 18) extend downwardly from the interior of the center fin 184. The body portion 182 terminates in a lower peripheral edge 186, which extends around the entire perimeter of the radome 180. The lower peripheral edge 186 is configured to closely conform to the particular automotive vehicle body panel on which the antenna assembly will be mounted. The close contour design achieves a "zero gap" appearance between the antenna and the vehicle.

The antenna element 170 may be secured within the radome 180 using techniques known to those skilled in the art. The lower portion 172 of the antenna element 170 extends through an opening in the connector piece 160 (FIG. 18) into the groove 152 in the base assembly 110 for effective coupling to the PC board assembly 114. In various exemplary embodiments, electrical contact between the antenna element 170 and the PC board assembly 114 may be accomplished with electrically-conductive elastomer. Alternative embodiments may include other means for electrically coupling the antenna element 170 of the radome assembly 120 with the PC board assembly 114, such as a metal contact spring, etc. For example, other embodiments may include electrical coupling that is inductive or galvanic using other coupling techniques.

The antenna element 170 shown in FIG. 14 may be designed for cellular phone signals. Alternatively, the antenna element 170 could be designed for other signals. It is envisioned that more than one antenna element could be included in the radome assembly. It also is envisioned that other embodiments may be configured without any antenna element in the radome assembly, in which case the center fin 184 might be omitted.

Figure 19:
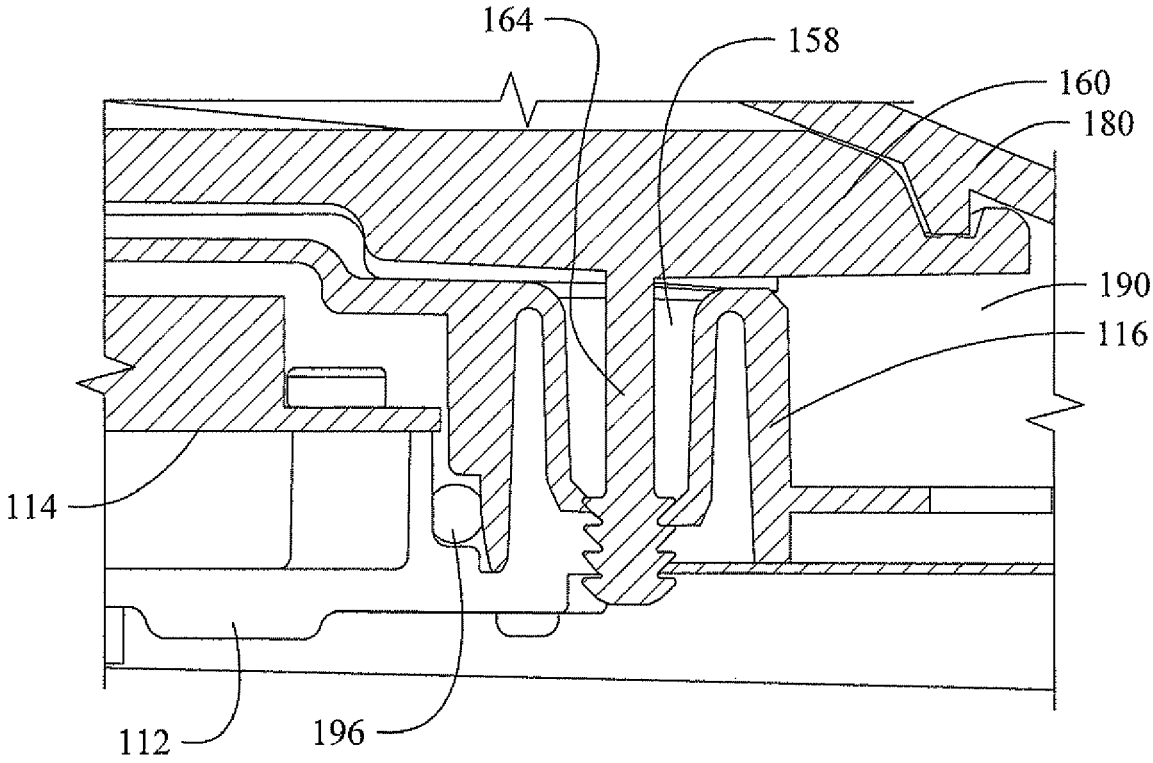
FIG. 19 is a partial side elevational view illustrating an exemplary connector piece, with the radome base assembly shown in FIG. 18 assembled onto the base assembly shown in FIGS. 15 and 16.

With continued reference to FIG. 14, the connector piece 160 provides a means of connecting the radome assembly 120 to the base assembly 110. FIG. 19 illustrates an exemplary manner by which the connector piece 160 allows for the connection of the radome assembly 120 to the base assembly 110. As shown, the connector piece 160 includes downwardly-extending barbed connectors 164 that are received in the receivers 158 of the base cover 116.

In the assembled state of the radome assembly 120 as shown in FIG. 18, the connector piece 160 is closely received within the body portion 182 of the radome 180 with the antenna element 170 secured therebetween. The connector piece 160 and radome 180 may be solvent welded together. Alternatively means (e.g., adhesive, etc.) may also be used to intersecure the components.

An exemplary installation process will now be described for the base assembly 110 and radome assembly 120. In various embodiments, the base assembly 110 is not specific to a vehicle platform. Instead, the base assembly 110 may be used across a wide variety of vehicle platforms having a wide variety of body panel configurations. The base assembly 110 may be delivered to the vehicle manufacturer for installation on a vehicle during vehicle assembly in conventional fashion—typically to the vehicle roof.

The radome assembly 120 may also be delivered to the vehicle manufacturer. But the radome assembly 120 typically is not installed on the vehicle during vehicle assembly. Because of the height restrictions related to vehicle shipping, the radome assembly 120 may be shipped uninstalled with the vehicle, for example, in the glove box of the vehicle. After the vehicle is received by the dealer, the radome assembly 120 may be removed from the glove box and installed on the base assembly 110 simply by aligning the fingers 64 (FIGS. 14 and 18) of the radome assembly 120 with the receivers 158 of the base assembly 110 (FIGS. 13 and 15), and then pushing the radome assembly 120 generally downwardly onto the base assembly 110. After being installed, the lower edge 186 of the radome 180 lies against and conforms to the vehicle body panel. The radome 180 can be color matched to the vehicle.

Accordingly, the present disclosure includes various embodiments of antenna assemblies for automotive vehicles, which may include a common base assembly (e.g., 10, 110, etc.) capable of being used across a wide variety of vehicle platforms. In such embodiments, the radome assembly (e.g., 20, 120, etc.) may be customized to a vehicle platform to fit closely against the body panel to achieve a zero gap appearance. Thus, economies of scale may be realized in both design and manufacturing because the base assembly need not be redesigned for different vehicle platforms. Consequently, exemplary embodiments of the present disclosure may thus allow for reduced manufacturing and inventory costs. Further, a plurality of radomes of virtually unlimited styles and colors may be used in conjunction with a single base assembly.

Embodiments and aspects of the present disclosure may be used in a wide range of antenna applications, such as patch antennas, telematics antennas, antennas configured for receiving satellite signals (e.g., Satellite Digital Audio Radio Services (SDARS), Global Positioning System (GPS), cellular signals, etc.), terrestrial signals, antennas configured for receiving RF energy or radio transmissions (e.g., AM/FM radio signals, etc.), combinations thereof, among other applications in which wireless signals are communicated between antennas. Accordingly, the scope of the present disclosure should not be limited to only one specific form/type of antenna assembly.

In addition, various antenna assemblies and components disclosed herein may be mounted to a wide range of supporting structures, including stationary platforms and mobile platforms. For example, an antenna assembly disclosed herein could be mounted to supporting structure of a car, truck, bus, train, aircraft, bicycle, motorcycle, among other mobile platforms. Accordingly, the specific references to automotive vehicles herein should not be construed as limiting the scope of the present disclosure to any specific type of supporting structure or environment.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

The description of the disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. An automotive vehicle antenna comprising:

a base assembly mountable on a vehicle, the base assembly including a chassis, a base cover coupled to the chassis, and two or more antenna elements mounted on a board of a printed circuit board assembly within an interior collectively defined by the chassis and the base cover, and respectively configured for reception of satellite radio signals and global positioning system (GPS) signals; and a radome assembly attachable to the base assembly, the radome assembly including a lower peripheral edge adapted to closely conform to the vehicle when the antenna is mounted on the vehicle, a radome, and at least one antenna element within the radome.

2. An automotive vehicle antenna as defined in claim 1 wherein the base assembly and the radome assembly include means for snap-fitting the radome assembly onto the base assembly.

3. An automotive vehicle antenna as defined in claim 2 where the snap-fitting means includes barbs.

4. An automotive vehicle antenna as defined in claim 1 further comprising means for contacting the at least one antenna element of the base assembly and the at least one antenna element of the radome assembly.

5. An automotive vehicle antenna as defined in claim 1 wherein the base cover is adapted to connect to the radome assembly.

6. An automotive vehicle antenna as defined in claim 1 wherein the radome assembly includes a connector piece attached to the radome, the connector piece adapted to connect to the base assembly.

7. An automotive vehicle antenna as defined in claim 1 wherein, in the final installed position of the antenna to a vehicle body wall of the vehicle, the lower peripheral edge of the radome assembly closely conforms to the vehicle body wall to thereby achieve a zero gap appearance.

8. An automotive vehicle antenna as defined in claim 1 wherein, in the final installed position of the antenna to a vehicle body wall of the vehicle, the lower peripheral edge of the radome assembly abuts against the vehicle body wall.

9. An automotive vehicle antenna as defined in claim 1 wherein:

the base assembly includes a forward portion having at least one socket and a rearward portion having at least two sockets; and the radome assembly includes a forward portion having at least one connector engageable with the at least one socket of the base assembly forward portion, and a rearward portion having at least two connectors engageable with corresponding sockets of the base assembly rearward portion.

10. An automotive vehicle antenna as defined in claim 1 wherein:

a forward portion of the antenna includes at least one latching mechanism;

a rearward portion of the antenna includes at least two latching mechanisms; and the latching mechanisms operable for attaching the radome assembly to the base assembly.

11. An automotive vehicle antenna as defined in claim 1 wherein the base assembly is configured for use as a common base assembly with different radome assemblies that are uniquely customized for different vehicle platforms to fit closely against the vehicle body wall to thereby achieve a zero gap appearance therewith.

12. An automotive vehicle antenna as defined in claim 1 wherein:

the base assembly includes at least one socket; and the radome assembly includes at least one connector extending downwardly therefrom to be received within the at least one socket of the base assembly to thereby allow the radome assembly to snap-fit onto the base assembly.

13. An automotive vehicle antenna as defined in claim 12 wherein the at least one connector comprises at least one barbed snap finger.

14. An automotive vehicle comprising:

a vehicle portion; and an antenna assembly as defined in claim 1, with the base assembly mounted on the vehicle portion, and the radome assembly mounted on the base assembly, the radome assembly including a skirt terminating in the peripheral lower edge closely conforming to the vehicle portion.

15. An automotive vehicle as defined in claim 14 wherein the base assembly and the radome assembly include means for snap-fitting the radome assembly onto the base assembly.

16. An automotive vehicle as defined in claim 15 where the snap-fitting means includes barbs.

17. An automotive vehicle as defined in claim 14 further comprising means for contacting the at least one antenna element of the base assembly and the at least one antenna element of the radome assembly.

18. An automotive vehicle as defined in claim 14 wherein the base cover is adapted to connect to the radome assembly.

19. An automotive vehicle as defined in claim 14 wherein the radome assembly includes a connector piece attached to the radome, the connector piece adapted to connect to the base assembly.

20. An automotive vehicle as defined in claim 14 wherein, in the final installed position of the radome assembly and base assembly to the vehicle portion, the peripheral lower edge of the skirt closely conforms to the vehicle portion to thereby achieve a zero gap appearance.

21. An automotive vehicle as defined in claim 14 wherein, in the final installed position of the radome assembly and base assembly to the vehicle portion, the peripheral lower edge of the skirt abuts against the vehicle portion.

22. An automotive vehicle antenna comprising:

a base assembly mountable on a vehicle, the base assembly including a chassis, a base cover coupled to the chassis, and at least one antenna element within an interior collectively defined by the chassis and the base cover; and a radome assembly attachable to the base assembly, the radome assembly including a lower peripheral edge adapted to closely conform to the vehicle when the antenna is mounted on the vehicle, a radome, and at least one antenna element within the radome;

wherein:

the radome includes a body portion terminating in the lower peripheral edge, a fin extending upwardly from the body portion, and at least one locator element extending downwardly relative to the fin; and the radome assembly includes a connector piece having a body defining at least one slot for receiving the at least one locator element of the radome to thereby assist in locating the radome and the connector piece, the body also defining at least one opening configured for receiving therethrough a lower portion of the at least one antenna element within the radome.

23. An automotive vehicle antenna as defined in claim 22 wherein the base assembly and the radome assembly include means for snap-fitting the radome assembly onto the base assembly.

24. An automotive vehicle antenna as defined in claim 22 wherein:

the base assembly and the radome assembly include means for snap-fitting the radome assembly onto the base assembly.

25. The automotive vehicle antenna as defined in claim 22 wherein the at least one antenna element within the interior collectively defined by the chassis and the base cover comprises two or more antenna elements mounted on a board of a printed circuit board assembly within the interior collectively defined by the chassis and the base cover, and respectively configured for reception of satellite radio signals and global positioning system (GPS) signals.

26. An automotive vehicle antenna comprising:

a base assembly mountable on a vehicle, the base assembly including a chassis, a base cover coupled to the chassis, and at least one antenna element within an interior collectively defined by the chassis and the base cover; and a radome assembly attachable to the base assembly, the radome assembly including a lower peripheral edge adapted to closely conform to the vehicle when the antenna is mounted on the vehicle, a radome, and at least one antenna element within the radome;

wherein:

the base cover includes a generally planar body having portions defining a groove therebetween for receiving a lower end portion of the at least one antenna element within the radome, a perimeter skirt extending generally downwardly from the body of the base cover, and at least one spring-loaded catch extending generally downwardly from the body; and the chassis includes a generally planar body, a groove extending generally around an upper surface of the body of the chassis for receiving a lower edge of the perimeter skirt of the base cover, and at least one receiver for receiving the at least one catch of the base cover to thereby allow the base cover to snap-fit onto the chassis.

27. A method relating to installation of an antenna assembly, the method comprising:

attaching a base assembly to a vehicle, the base assembly including a chassis, a base cover coupled to the chassis, and two or more antenna elements mounted on a board of a printed circuit board assembly within an interior collectively defined by the chassis and the base cover, and respectively configured for reception of satellite radio signals and global positioning system (GPS) signals;

shipping a radome assembly with the vehicle having the base assembly attached thereto, the radome assembly including a lower peripheral edge adapted to closely conform to the vehicle when the antenna is mounted on the vehicle, a radome, and at least one antenna element within the radome; and subsequent to shipping, attaching the radome assembly to the base assembly.

28. A method as defined in claim 27 wherein attaching the radome assembly comprises snap-fitting the radome assembly onto the base assembly.

29. A method as defined in claim 27 wherein attaching the radome assembly comprises receiving at least one connector extending downwardly from the radome assembly within at least one socket of the base assembly to thereby snap-fit the radome assembly onto the base assembly.

30. A method as defined in claim 27 wherein attaching the radome assembly comprises positioning the lower peripheral edge of the radome assembly in close conformance with a vehicle body wall to thereby achieve a zero gap appearance.

31. A method as defined in claim 27 wherein attaching the radome assembly comprises abutting the lower peripheral edge of the radome assembly against a vehicle body wall.

32. A method relating to installation of an antenna assembly, the method comprising attaching a radome assembly to a base assembly such that a lower peripheral edge of the radome assembly is in close conformance with a vehicle body wall to which the base assembly is attached, to thereby achieve a zero gap appearance, wherein:

the radome assembly includes a radome and at least one antenna element within the radome;

the base assembly includes a chassis, a base cover coupled to the chassis, and two or more antenna elements mounted on a board of a printed circuit board assembly within an interior collectively defined by the chassis and the base cover, and respectively configured for reception of satellite radio signals and global positioning system (GPS) signals.

33. A method as defined in claim 32 wherein attaching the radome assembly comprises snap-fitting the radome assembly onto the base assembly.

34. A method as defined in claim 32, wherein attaching the radome assembly comprises abutting the lower peripheral edge of the radome assembly against the vehicle body wall.

35. A method as defined in claim 32:

wherein the method includes attaching a first base assembly to a first vehicle; and attaching a second base assembly to a second vehicle associated with a different platform than the first vehicle, the first and second base assemblies having a common configuration; and wherein attaching a radome assembly to a base assembly includes:

attaching a first radome assembly to the first base assembly, the first radome assembly configured such that a lower peripheral edge thereof fits closely against the first vehicle to thereby achieve a zero gap appearance therewith;

attaching a second radome assembly to the second base assembly, the second radome assembly configured such that a lower peripheral edge thereof fits closely against the second vehicle to thereby achieve a zero gap appearance therewith.

* * * * *